US008747149B2

(12) United States Patent
Wu et al.

(10) Patent No.: US 8,747,149 B2
(45) Date of Patent: Jun. 10, 2014

(54) FOUR IN ONE ELECTRICAL CONNECTOR PLUG

(71) Applicant: Advanced-Connectek Inc., New Taipei (TW)

(72) Inventors: Hua Yan Wu, New Taipei (TW); Wei Wan, New Taipei (TW); Shu Lin Duan, New Taipei (TW); Fu Yi Xu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 75 days.

(21) Appl. No.: 13/679,038

(22) Filed: Nov. 16, 2012

(65) Prior Publication Data

US 2014/0017916 A1 Jan. 16, 2014

(30) Foreign Application Priority Data

Jul. 16, 2012 (CN) ..... 201210244984

(51) Int. Cl.
*H01R 13/60* (2006.01)
*H01R 13/648* (2006.01)

(52) U.S. Cl.
USPC ..... 439/540.1; 439/108; 439/607.23

(58) Field of Classification Search
USPC ..... 439/108, 660, 541.5, 540.1, 607.23
See application file for complete search history.

(56) References Cited

U.S. PATENT DOCUMENTS

| | | | | |
|---|---|---|---|---|
| 5,575,690 | A * | 11/1996 | Eaton | 439/717 |
| 6,887,108 | B2 * | 5/2005 | Wu | 439/638 |
| 7,118,414 | B2 * | 10/2006 | Spears et al. | 439/540.1 |
| 7,833,051 | B2 * | 11/2010 | Huang et al. | 439/541.5 |
| 7,942,702 | B2 * | 5/2011 | Chang | 439/638 |
| 8,025,534 | B2 * | 9/2011 | Bates et al. | 439/638 |
| 8,038,474 | B2 * | 10/2011 | Ju | 439/607.01 |
| 2005/0164548 | A1 * | 7/2005 | Spears et al. | 439/540.1 |
| 2007/0077811 | A1 * | 4/2007 | Kim et al. | 439/540.1 |

* cited by examiner

*Primary Examiner* — Briggitte R Hammond
(74) *Attorney, Agent, or Firm* — Rabin & Berdo, P.C.

(57) ABSTRACT

An electrical connector plug includes a casing an output/input port mounted having multiple upper terminals and multiple lower terminals, a trough defined between the upper terminals and the lower terminals, a circuit board inserted in the trough of the casing and having, a metal plate electrically connected to the ground terminal and a metal housing to entirely enclose the casing and to electrically connect to the metal plate such that the metal plate is able to transmit electromagnetic interference out via the metal housing.

4 Claims, 8 Drawing Sheets

FOUR IN ONE ELECTRICAL CONNECTOR PLUG

CROSS-REFERENCE TO RELATED APPLICATION

This application claims priority from application No. 201210244984.9, filed on Jul. 16, 2012 in the State Intellectual Property Office of The People's Republic of China.

FIELD OF THE INVENTION

The invention relates to an electrical connector plug and, more particularly, to a four-in-one electrical connector plug to integrate functions of power, USB2.0, USB3.0 and MiNi DP in one device.

BACKGROUND OF THE INVENTION

In order to accomplish the designated purposes, nowadays, data transmission or electrical signals are transmitted via electrical connector of different types. Functionally, electrical connector are divided into electrical connector and signal transmission connector such as USB2.0 USB3.0 and MiNi DP.

Universal Serial Bus; USB, is a standard connector used between a computer system and an exterior device, also an interface technology standard for input/output. This device is widely used in personal computers and mobile devices such as smart phones, personal data assistant; PDA and the like. It is even expanded to recording equipment, digital TVs, video games and others.

As the advance of modern technology and the increasingly increased demand for high transmission speed and high storage capacity, the transmission speed of USB 1.0 (Max Speed 12 Mbps) is now upgraded to USB2.0 with a transmission speed of 480 Mbps. Currently, the most updated version USB3.0 has a transmission speed of 5 Gps to satisfy users' requirements in time and speed when a large chunk of files occupied a large amount of space are being sent simultaneously.

MiNi DP, which was issued by Apple™ on Oct. 14, 2008, is a micro version of display port for support of Mac Book (replacing the conventional Mini-DVI), MacBook Air (replacing the conventional Micro-DVI) and Mac Book Pro computers (replacing the conventional DVI). In all these conventional computers, the input and output of the connectors are individually manufactured and assembled, which unnecessarily increases a space in the electronic devices for accommodation of ports for the output and/or input and makes the electronic devices bulky. Adding spaces in the electronic devices also increases the cost for structure molding, which is definitely a bad influence for market compatibility.

SUMMARY OF THE INVENTION

The primary objective of the present invention is to provide an electrical connector plug which involves fewer components and less cost.

A main objective of the present invention is to provide a four-in-one electrical connector plug which is able to transmit power and data transmission.

In order to accomplish the aforementioned objective, the electrical connector plug of the preferred embodiment of the present invention includes:

a casing having:

a power port with a middle terminal and a power terminal;

a ground terminal mounted next to the power port;

an output/input port mounted next to the ground terminal and having multiple upper terminals and multiple lower terminals, wherein a ground terminal is mounted every two of the upper terminals and of the lower terminals so as to isolate the other two of the upper terminals and of the lower terminals;

a trough defined between the upper terminals and the lower terminals;

a circuit board inserted in the trough of the casing and having power contacts, output/input contacts, a power terminal contact and an output/input terminal contact;

a metal plate inserted between the power contacts and the output/input contacts of the circuit board to electrically connect to the ground terminal; and a metal housing composed of a front housing and a rear housing to entirely enclose the casing and to electrically connect to the metal plate such that the metal plate is able to transmit electromagnetic interference out via the metal housing.

The middle terminal has a first step formed on approximately the central portion of the middle terminal. The power terminal includes a left terminal with a second step formed thereon and a right terminal integrally formed with the left terminal to save manufacturing cost and solve temperature rise problem while in application and having a third step formed thereon.

The ground terminal is mounted between the power port and the output/input port to effectively prevent electromagnetic interference when in power transmission and signal output/input.

DETAILED DESCRIPTION OF THE INVENTION

Figure 1:
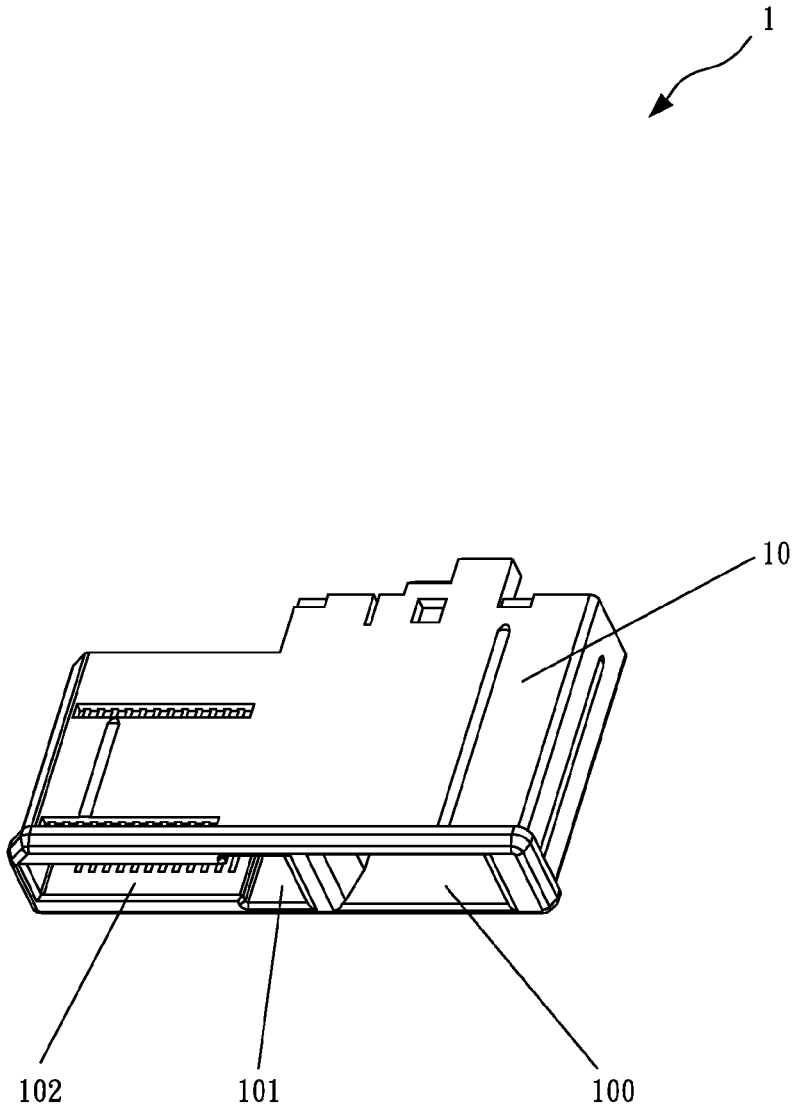
FIG. 1 is a perspective view of the casing in one embodiment of the present invention.
Figure 2C:
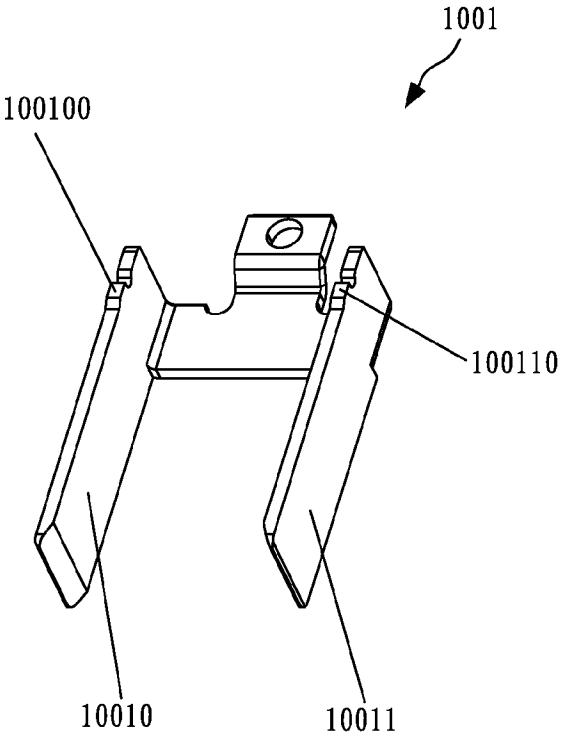
FIG. 2C is a perspective view of the power terminal in one embodiment of the present invention.
Figure 2B:
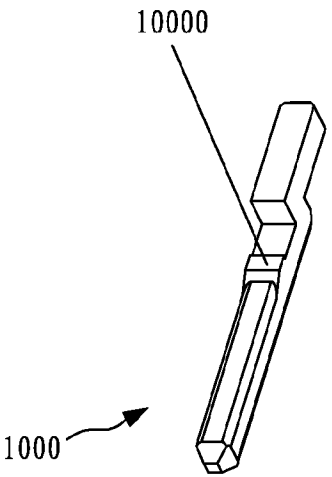
FIG. 2B is a perspective view of the middle terminal in one embodiment of the present invention.
Figure 2A:
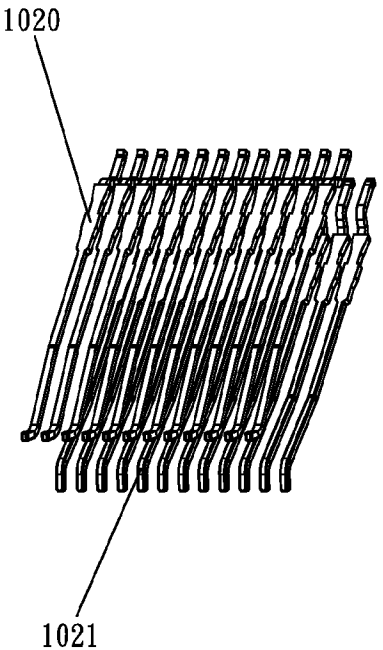
FIG. 2A is a perspective view showing the upper terminals and the lower terminals in one embodiment of the present invention.
Figure 3:
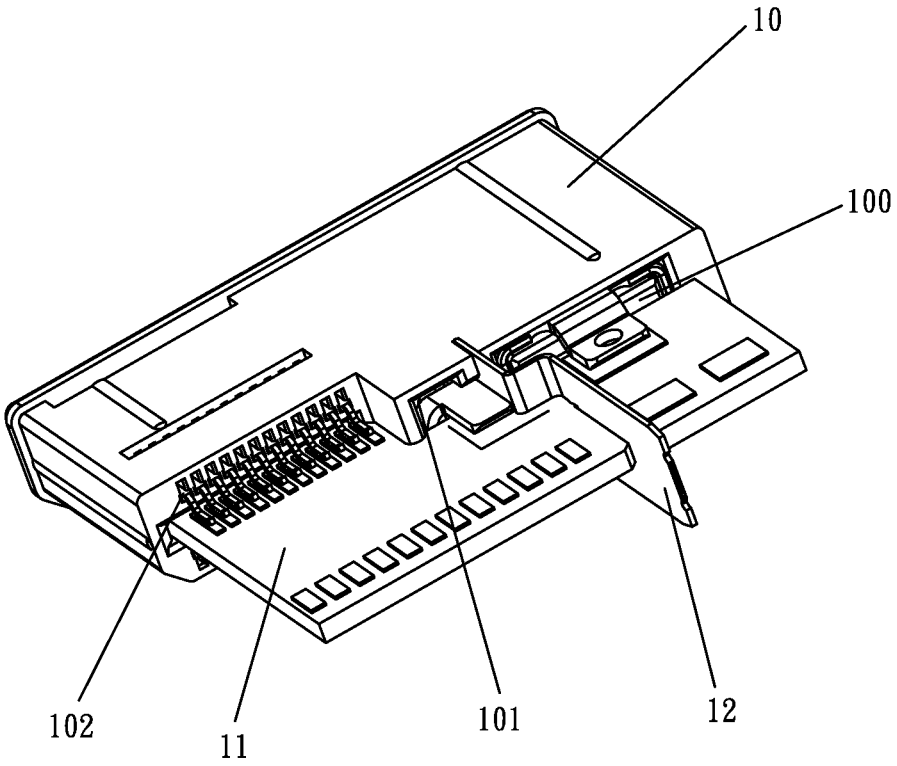
FIG. 3 is a perspective view of the casing in one embodiment of the present invention.
Figure 4B:
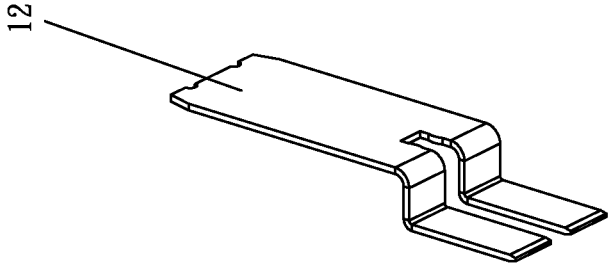
FIG. 4B is a schematic perspective view of the metal plate in one embodiment of the present invention.
Figure 4A:
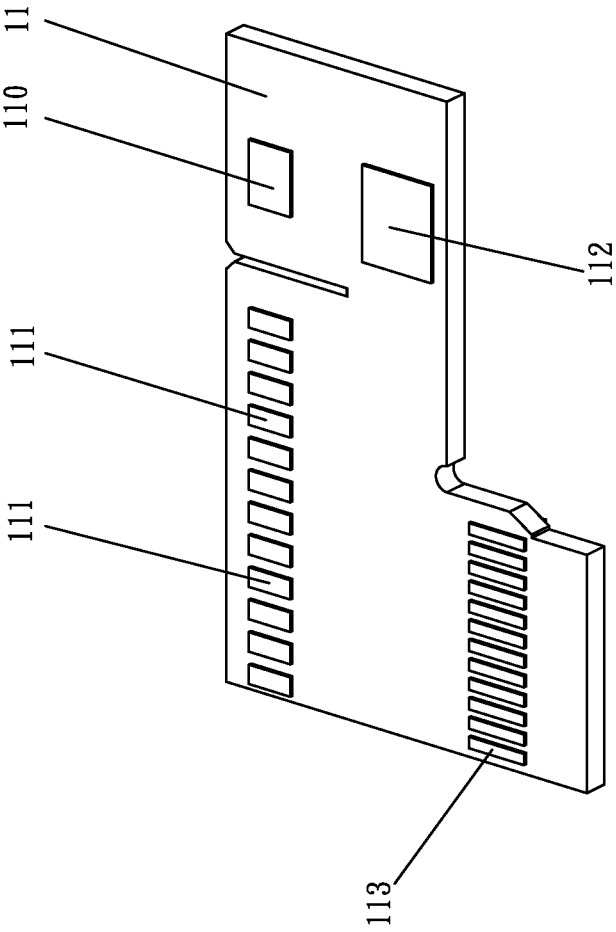
FIG. 4A is a perspective view of the circuit board in one embodiment of the present invention.
Figure 5:
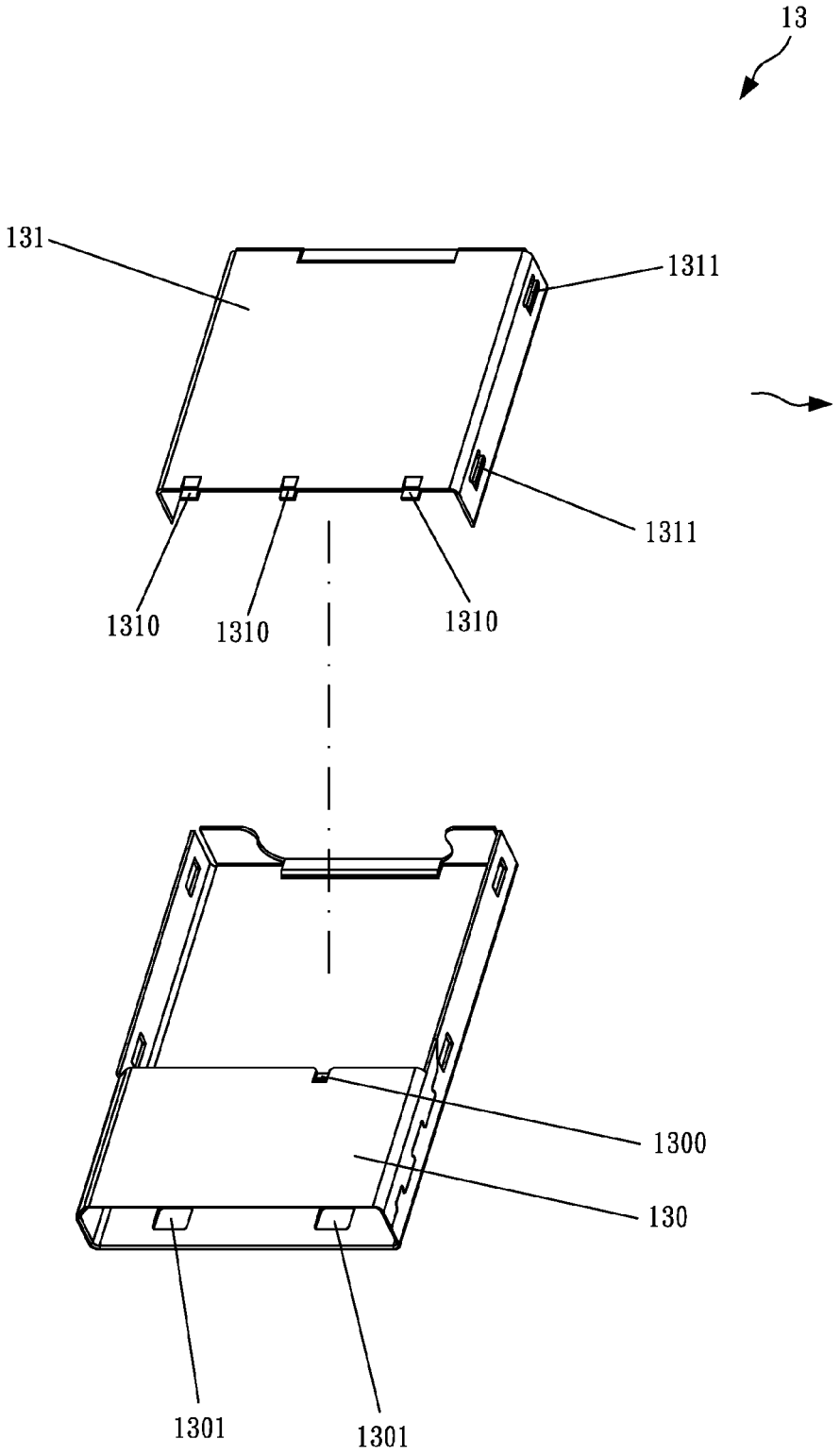
FIG. 5 is an exploded perspective view of the housing in one embodiment of the present invention.
Figure 6:
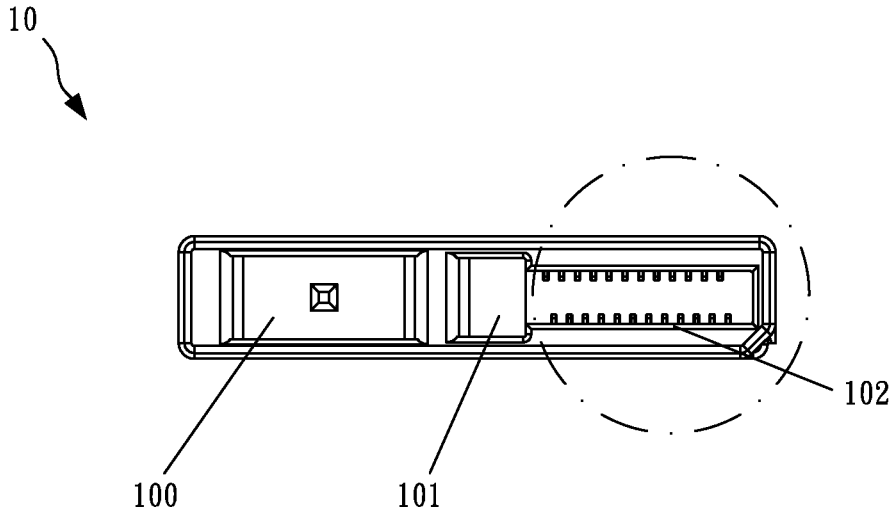
FIG. 6 is a schematic plan view showing arrangement of the upper terminals and the lower terminals.
Figure 6A:
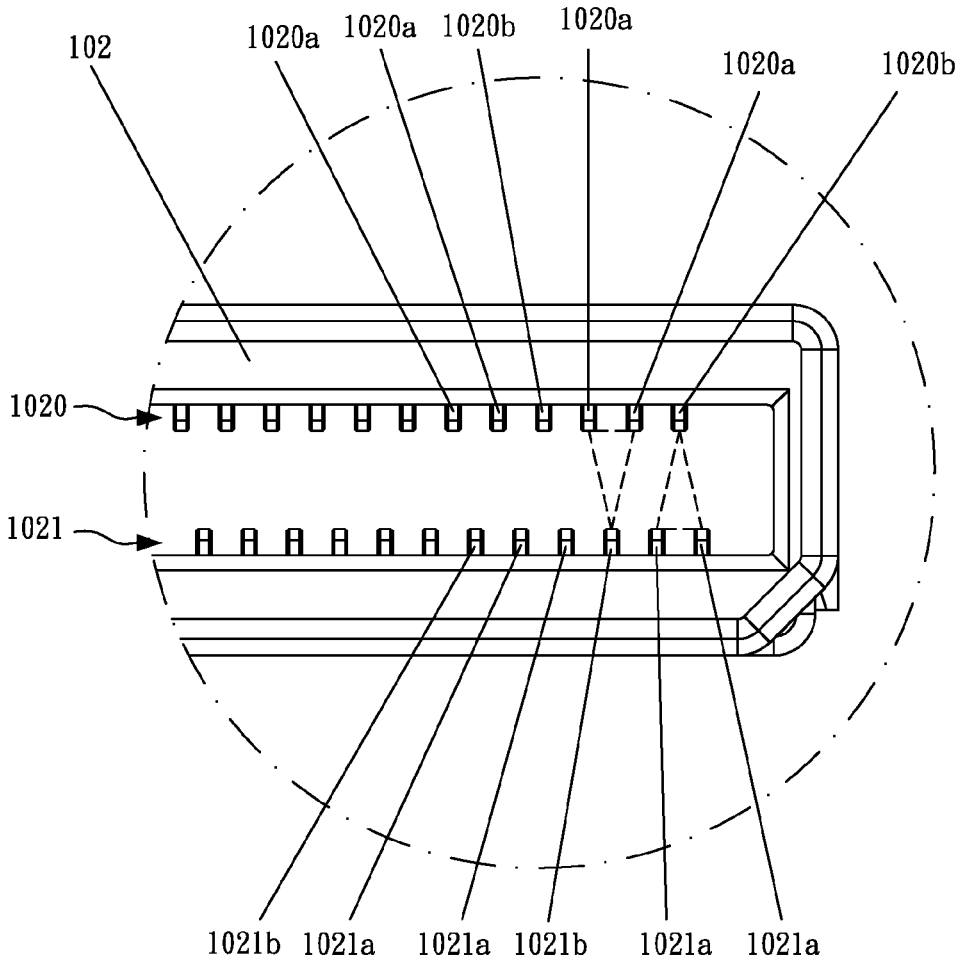
FIG. 6A is an enlarged plan view showing the relative position of the upper terminals with respect to the ground terminals.
Figure 7:
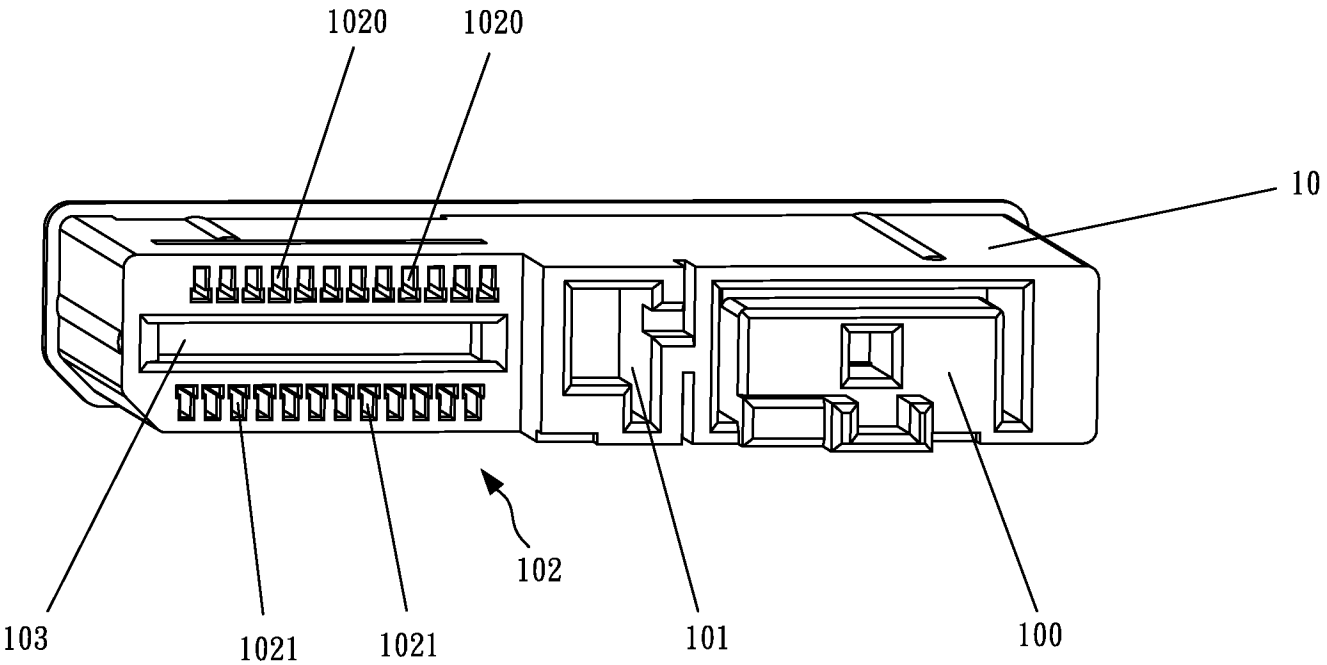
FIG. 7 is a perspective view showing the casing in one embodiment of the present invention.

With reference to FIGS. 1 to 7, the electrical connector plug 1 constructed in accordance with the preferred embodiment of the present invention is composed of:

a casing 10 having:

a power port 100 a middle terminal 1000 and a power terminal 1001;

a ground terminal 101 mounted next to the power port 100;

an output/input port 102 mounted next to the ground terminal 101 and having multiple upper terminals 1020 and multiple lower terminals 1021, wherein a ground terminal 1020*a*;1021*b* is mounted every two of the upper terminals 1020*a* and of the lower terminals 1021*a* so as to isolate the other two of the upper terminals 1020*a* and of the lower terminals 1021*a;* a trough 103 defined between the upper terminals 1020 and the lower terminals 1021;

a circuit board 11 inserted in the trough 103 of the casing 10 and having power contacts 110, output/input contacts 111 for easy wire bonding, a power terminal contact 112 and an output/input terminal contact 113;

a metal plate 12 inserted between the power contacts 110 and the output/input contacts 111 of the circuit board 11 to electrically connect to the ground terminal 101; and a metal housing 13 composed of a front housing 130 and a rear housing 131 to entirely enclose the casing 10 and to electrically connect to the metal plate 12 such that the metal plate 12 is able to transmit electromagnetic interference out via the metal housing 13.

The middle terminal 1000 has a first step 10000 formed on approximately the central portion of the middle terminal 1000. The power terminal 1001 includes a left terminal 10010 with a second step 100100 formed thereon and a right terminal 10011 integrally formed with the left terminal 10010 to save manufacturing cost and solve temperature rise problem while in application and having a third step 100110 formed thereon.

The ground terminal 101 is mounted between the power port 100 and the output/input port 102 to effectively prevent electromagnetic interference when in power transmission and signal output/input.

When in assembly, the upper terminals 1020 and the lower terminals 1021 are inserted into the output/input port 102 and the circuit board 11 is inserted into the trough 103 so as to precisely locate the position of the circuit board 11. Then, the power terminal 1001 is securely connected to the power terminal contact 112 via surface mounting technology; SMT. The upper terminals 1020 as well as the lower terminals 1021 are also securely connected to the output/input terminal contact 113 via SMT to save manufacture cost and enable standardized production. The metal plate 12 is securely connected between the power contact 110 and the output/input contacts 111. Therefore, the metal housing 13 is provided to enclose the casing 10.

In one embodiment of the present invention, the casing 10 which is made of plastic has an outer frame so that when the casing 10 is combined with the metal housing 13, the casing 10 is substantially flush with the metal housing 13. The plastic material chosen for the casing 10 is durable for heat and the color thereof may be subject to change to meet requirements.

In one embodiment of the present invention, the first step 10000, the second step 100100 and the third step 100110 respectively are formed to have a stepped shape such that the middle terminal 1000, the left terminal 10010 and the right terminal 10011 respectively have much better durability when compared with the conventional structure. The middle terminal 1000 is made of a material with a thickness of 1 mm and has a cross section of 1 $mm^2$ after being made. As the cross section area becomes larger than the conventional one, engagement with other devices or elements is sufficient and possibility of having bad engagement is eliminated. The maximum transmissible current for the power terminal 1001 is 7 ampere.

In still another embodiment of the present invention, the circuit board 11 is of a T shape. The output/input terminal contact 113 is located at the protruding portion of the T shape configuration to allow the circuit board 11 to combine with the trough of the casing 10 more easily. However, the description should not be deemed as limitation to the structure or function of the elements just described. The output/input terminal contact 113 may also be located at the recessed area of the T shape structure. Also, the circuit board 11 may be of an N shape or of an L shape. When it is of the N shape, the output/input terminal contact 113 may be formed at the protruding portion or the recessed area. When it is of the L shape, the output/input terminal contact 113 may be formed at the vertical portion or the horizontal portion.

The upper terminals 1020 and the lower terminals 1021 are formed in a triangular configuration. That is, two terminals 1020*a,* 1021*a* on the same side correspond to one ground terminal 1020*b,* 1021*b* on the other side so as to effectively prevent electromagnetic interference among terminals. Also, with the stepped configuration in the upper terminals 1020 and the lower terminals 1021, it is possible to remove the upper terminals 1020 and the lower terminals 1021 in high temperature. The upper terminals 1020 and the lower terminals 1021 are able to transmit signals of various formats such as USB2.0, USB3.0 and MiNi DP.

It is to be noted that the front housing 130 has notches 1300 defined in a middle portion thereof to enhance engagement with the casing 10 and at least one openings 1301 defined in a sidewall thereof to allow the metal housing to be removed in high temperature.

The rear housing 131 has at least three snap protrusions 1310 formed on a front end face thereof so that when the rear housing 131 is in assembly with the casing 10, the at least three snap protrusions 1310 ensure secured engagement between the metal housing 13 and the casing 10.

After the description, it is to be noted that the product described and shown in the accompanying drawings is compact in size, light weight, high compatibility and simple in structure. The product not only has power transmission capability as the conventional one(s), it also has the ability to transmit high frequency signals of USB2.0, USB3.0 and MiNi DP.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. An electrical connector plug comprising:

a casing having:

a power port with a middle terminal and a power terminal;

a ground terminal mounted next to the power port;

an output/input port mounted next to the ground terminal and having multiple upper terminals and multiple lower terminals, wherein a ground terminal is mounted every two of the upper terminals and of the lower terminals so as to isolate the other two of the upper terminals and of the lower terminals;

a trough defined between the upper terminals and the lower terminals;

a circuit board inserted in the trough of the casing and having power contacts, output/input contacts, a power terminal contact and an output/input terminal contact;

a metal plate inserted between the power contacts and the output/input contacts of the circuit board to electrically connect to the ground terminal; and a metal housing composed of a front housing and a rear housing to entirely enclose the casing and to electrically connect to the metal plate such that the metal plate is able to transmit electromagnetic interference out via the metal housing.

2. The electrical connector plug as claimed in claim 1, wherein the middle terminal has a first step formed in a middle portion thereof, the power terminal is composed of a left terminal with a second step formed thereon and a right terminal integrally formed with the left terminal and provided with a third step formed thereon.

3. The electrical connector plug as claimed in claim 1, wherein the upper terminals are crisscross arranged relative to the lower terminals.

4. The electrical connector plug as claimed in claim 1, wherein the front housing has at least one opening defined therein.

* * * * *